US005732588A

United States Patent [19]

Pahnke

[11] Patent Number: 5,732,588

[45] Date of Patent: Mar. 31, 1998

[54] DOUBLE PRESS

[75] Inventor: Hans-Joachim Pahnke, Düsseldorf, Germany

[73] Assignee: Pahnke Engineering GmbH & Co. K.G., Düsseldorf, Germany

[21] Appl. No.: 702,475

[22] PCT Filed: Oct. 27, 1995

[86] PCT No.: PCT/EP95/04226

§ 371 Date: Aug. 26, 1996

§ 102(e) Date: Aug. 26, 1996

[87] PCT Pub. No.: WO96/20053

PCT Pub. Date: Jul. 4, 1996

[30] Foreign Application Priority Data

Dec. 24, 1994 [DE] Germany ..... 44 46 580.7

[51] Int. Cl.[6] ..... B21J 7/14; B21J 7/28

[52] U.S. Cl. ..... 72/403; 72/453.02

[58] Field of Search ..... 72/402, 403, 453.02, 72/453.08, 453.01

[56] References Cited

U.S. PATENT DOCUMENTS

| | | | |
|---|---|---|---|
| 3,460,370 | 8/1969 | Kralowetz | 72/405 |
| 3,645,126 | 2/1972 | Kralowetz et al. | 72/402 |
| 3,681,966 | 8/1972 | Kralowetz | 72/402 |
| 3,817,070 | 6/1974 | Ribback | 72/402 |
| 3,841,125 | 10/1974 | Guse | 72/402 |
| 3,916,667 | 11/1975 | Paknke | 72/402 |
| 4,941,342 | 7/1990 | Herndl | 72/402 |

FOREIGN PATENT DOCUMENTS

| | | | |
|---|---|---|---|
| 492 281 | 12/1949 | Belgium . | |
| 20 30 471 A | 1/1971 | Germany . | |
| 13 03 852 B | 7/1973 | Germany . | |
| 22 21 341 A1 | 11/1973 | Germany . | |
| 29 51 587 A1 | 7/1981 | Germany . | |
| 38 00 220 C1 | 2/1989 | Germany . | |
| 479554 | 8/1975 | U.S.S.R. | 72/402 |
| 708589 | 6/1986 | U.S.S.R. | 72/402 |
| 1323194 | 7/1987 | U.S.S.R. | 72/402 |

*Primary Examiner*—Daniel C. Crane

*Attorney, Agent, or Firm*—Milton Oliver, Esq. Ware, Fressola, Van Der Sluys & Adolphson LLP

[57] ABSTRACT

The invention pertains to a double press for forging round or edged bar-shaped workpieces using two presses set at 90° to each other, each having a pair of forging tools (A1, A2, B1, B2) that hydraulically work pairs I and II of the forging tools being driven alternatingly and each of the pump assemblies (5,6) being connected on its delivery side to a piston-cylinder unit (1,3) of a forging tool (A1, A2) of the one pair I and on its suction side to a piston-cylinder unit (2,4) of a forging tool (B1, B2) of the other pair II, and with the main lines (21, 22, 23, 24) between the pump assemblies (5,6) and the piston-cylinder units (1, 2, 3, 4) being free of valves. The delivery direction of the pump assemblies (5,6) is reversible, so that the pumps' delivery and suction sides change with a reversal of the delivery direction.

15 Claims, 2 Drawing Sheets

DOUBLE PRESS

This application is a 371 of PCT/EP95/04226, filed Oct. 27, 1997.

FIELD OF THE INVENTION

The invention relates generally to a double press for forging round or edged bar-shaped workpieces using two pairs of forging dies offset at 90° angles from one another and working against each other where said forging dies may be driven hydraulically by two pump assemblies.

BACKGROUND

The basic design of each double press unit consists of two cylinder-piston units working against each other and forming the workpiece without moving its center axis, as is, for instance, described in the German disclosure paper 2 221 341, Schmoll. Two such presses are arranged one after another in the longitudinal axis of the workpiece, offset at a 90 degree angle from one another, such that they can form bar-shaped workpieces perpendicular to the longitudinal axis in two planes.

Simultaneous forming of bar-shaped material in two planes perpendicular to the longitudinal axis of the workpiece with so-called forging machines is generally known. However, with the exception of the machine described in my DE 38 00 220 C1, all such machines use four dies in one plane. Due to their design, they are limited in die width or in stroke length and cannot operate with metallurgically advantageous deformation values.

Although the machine according to my DE 38 00 220 C1 is capable of operating with two pairs of dies offset in the longitudinal axis of the die, their working cylinders are still in one plane, and thus would be exposed to strong eccentric forces if the die widths required for freeforming conditions were used.

A forging machine where synchronization of the cylinder-piston units working against each other is accomplished by articulated levers connecting the forging dies via a gliding piece that glides in a guide perpendicular to the working axis is known from DE 29 51 587, Betz. The gliding piece is impacted by a pull-back cylinder, which causes the forging dies to be pulled back via the articulated pieces. The function of pulling back the forging dies can be accomplished by an additional pair of cylinder-piston units working against each other that is located perpendicular to the first pair in the same plane. This ensures the synchronized alternating drive of the two piston pairs.

A significant disadvantage of the forging machine mentioned is that mechanical synchronization does not allow for stroke variations of the forging dies. However, adjusting the stroke to the decreasing material thickness would lead to shorter set times of the pistons resulting in highly desirable faster forging and in reduced energy consumption. In addition, controlling the cylinder-piston unit with valves in the main lines limits the stroke frequency.

An additional disadvantage of mechanical synchronization is the enormous wear of the gliding piece guides or forging dies caused by the forces acting on the articulated levers, thus straining the guides with a component vertical to the working axis. Arranging two freeform presses in sequence is also not practical with the technical solution described.

When controlled by hydraulic valves, a big portion of the drive energy of such forging machines is lost by compressing the large amount of pressure medium that cannot be used effectively but heats up pressure medium and machine requiring cooling.

SUMMARY OF THE INVENTION

It is the objective of this invention to provide a double press that eliminates the design disadvantages of the forging machine according to DE 38 00 220 and that is less expensive to manufacture. In addition, it should be facilitated to operate with adjustable stroke and at high stroke frequency the two pairs of cylinder piston units (working against each other) of a forging machine, particularly the double press subject to the invention. It is also advantageous to use the power of the driving pump assemblies more efficiently and ensure precise synchronization of the forging dies with simple means.

This task is accomplished according to the invention by the two pairs of forging dies being arranged in two planes in the direction of the workpiece axis and offset from one another. The cylinder-piston units of the four forging dies of a double press, particularly of the one according to the invention, are driven alternatively, where each of the pump assemblies is connected to a cylinder-piston unit of a forging die of the one pair at its discharge side and with a cylinder-piston unit of a forging die of the other pair at its suction side. Suction and discharge sides alternate with the control reversal of the delivery direction. The main lines between the pump assemblies and the cylinder-piston units are free of valves and the delivery direction of the pump assemblies is reversible.

The embodiment according to the invention has the following advantages:

A double press with two freeform presses positioned in succession of and offset from one another can be manufactured more cost-efficiently than the forging machines mentioned. With the forging machine according to the invention, conventional freeform forging dies may be used to reduce cost. The design of the machine avoids the eccentric forces that put a strain on the machine.

The fact that the pairs of forging dies can be driven by two pump assemblies in the manner described and that the flow of the pressure medium in the main lines is not impeded by valves with their required switching times allows for significantly higher stroke frequencies of the forging dies.

The control according to the invention offers precise synchronization of the movement of the forging dies with significantly improved wear resistance. An electronic control unit permits easy individual adjustment of the stroke of each pair of forging dies. Individual adjustment of the stroke of the forging dies avoids unnecessary stroke distances, thus reducing energy requirements.

In addition to adjusting the individual stroke, the three-way valves allow for compensation of pressure medium losses caused by system leakages.

Since the pump assemblies work in both delivery directions and have no unused backstroke, fewer pumps are required to drive the cylinder-piston units resulting in the need for less pressure medium. The pump capacities are reduced by 50%.

In addition, the invention enables transformation of the energy needed to compress the pressure medium into usable mechanical energy. To this end, the shafts of the pump are furnished with flywheels storing the energy of the pumps, operating as hydraulic motors in the interim phase, and making the energy available to drive the pump. The pressure medium is practically not heated up by this energy conversion. Thus, the forging machine does not require auxiliary cooling.

By turning off one pump assembly, the electronic control enables one pair's forging die to be placed on and grip the workpiece, while the respective other pair of dies, driven by the other pump assembly, can operate at a high forging speed.

By using pumps that can be adjusted in their delivery capacity and reversed in their delivery direction, it is possible to reverse the stroke quickly and without shock with a sine-shaped die movement, while longer strokes are accomplished with a holding phase in the maximum delivery position. Pressure spikes at the reversing point, common with conventionally operating pumps, are avoided.

BRIEF FIGURE DESCRIPTION

Further details of an exemplary embodiment of the invention are set forth in the following description and associated drawings, of which FIG. 1 is a diagram of the double press; and FIG. 2 is a diagram of the double press drive.

DETAILED DESCRIPTION

Figure 1:
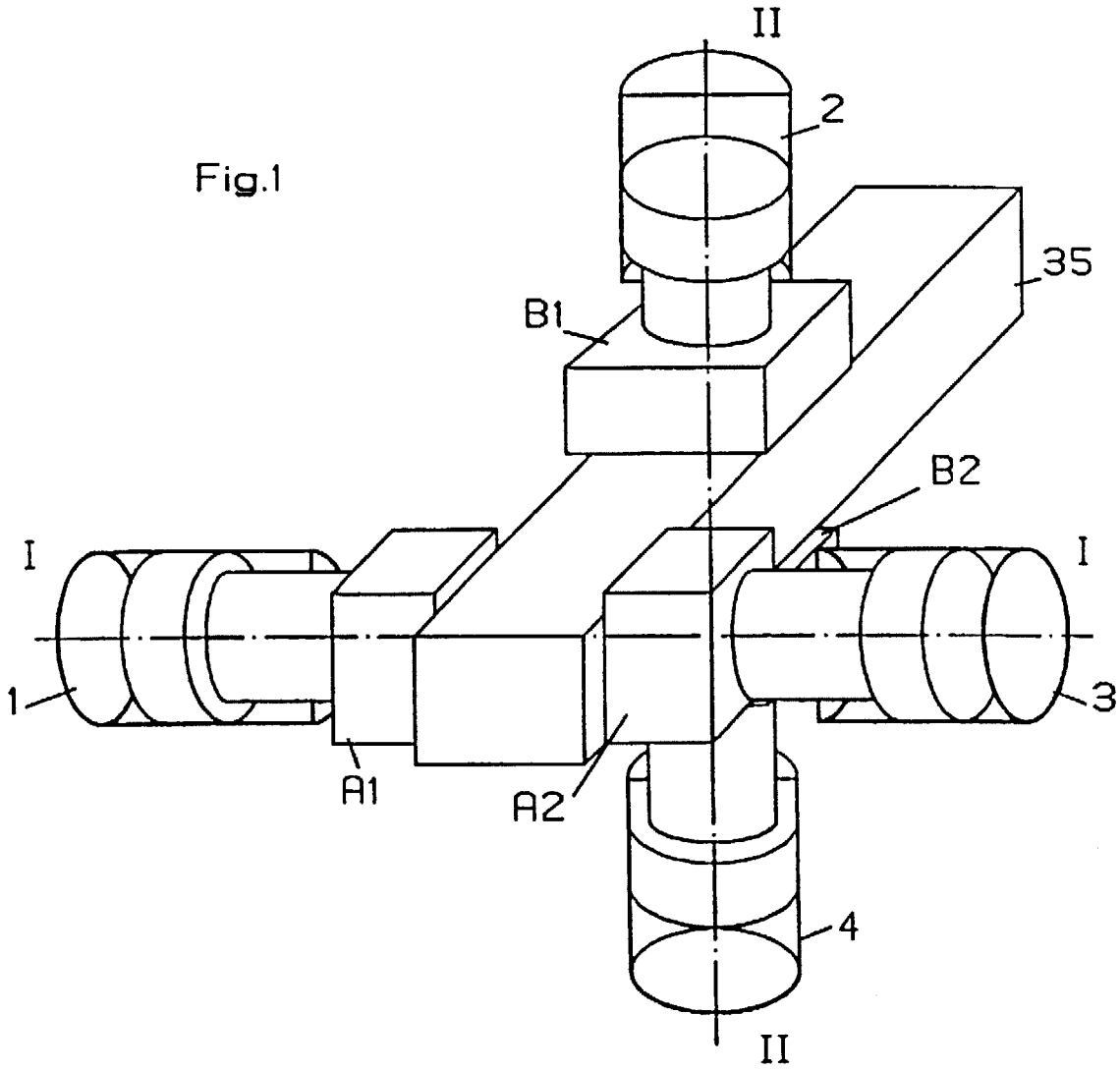
Figure 2:
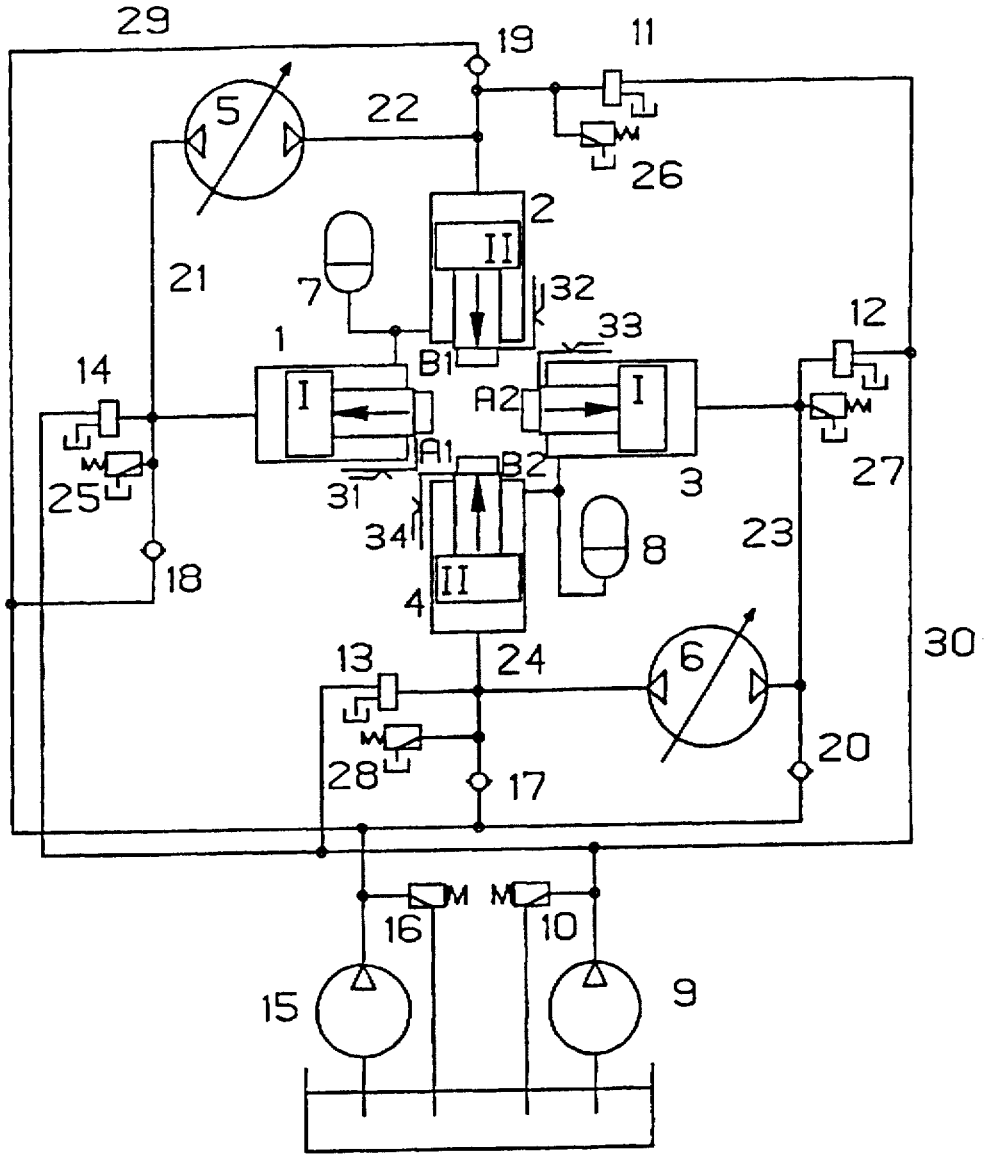

The first pair I of forging dies A1 and A2 is operated by two cylinder-piston units 1 and 3, and has a first axis of motion, e.g. horizontal as shown. The second pair II of forging dies B1 and B2 is operated by two other cylinder-piston units 2 and 4, and has a second axis of motion, e.g. vertical as shown. Pairs I and II of the forging dies are positioned at an angle of 90° to one another in two planes. They forge the workpiece 35.

Cylinder-piston units 1 and 2 are supplied with pressure medium by pump assembly 5 via main lines 21 and 22. The one main line 21 is connected to the discharge side of pump 5, the other main line 22 to the suction side of pump 5. Suction and discharge sides alternate with the reversal of the delivery direction. The cylinder-piston units 3 and 4 are supplied with pressure medium in the same manner by pump assembly 6 via main lines 23 and 24. Between pumps 5 and 6 and the cylinder-piston units 1, 2, 3, and 4, connected to the pumps, the main lines are free of valves.

Pump assemblies 5 and 6 consist of at least one pump, and in an advantageous embodiment of several pumps connected in parallel, where said pumps are preferably radial piston pumps that are continuously adjustable in their delivery amount and that are reversible in the delivery direction. Radial piston pumps excel in their quick regulating times and excellent controllability. Axial piston pumps or oscillating disk pumps may be used in place of the radial piston pumps.

The pull-back areas of the cylinders of pump assemblies 1 and 2, as well as those of pump assemblies 3 and 4, are connected to gas-pressurized liquid storage units 7 and 8 that maintain a constant pressure in the pull-back areas, thus supporting the backward movement of the respective piston.

In the direction of movement and in operating speed, the pistons of cylinder-piston units 1 and 2 follow the control of pump assembly 5. If the pump assembly discharges to the right, pressure medium is dram from cylinder 1, the piston moves outward as indicated by the arrow, the piston of cylinder 2 in the direction of the arrow inward. Stroke movements may be measured by a known method using measuring devices 31, 32, 33 and 34 attached to the forging dies. The signals of these measuring devices may also be used to control the rhythmical reversals.

Safety valves 25, 26, 27 and 28 are provided in branches of main lines 21, 22, 23 and 24 to protect the pump assemblies at overloads.

Main lines 21, 22, 23 and 24 are connected to a circuit with one fill line 29 via branches having check valves 17, 18, 19 and 20, with the circuit being fed by a priming pump 15 via priming valve 16. Pressure medium is automatically replenished through this separate circuit when the safety valves are actuated or when vacuum that could endanger pump assemblies 5 and 6 is building in the main lines 21, 22, 23 and 24.

Normally, the piston areas of the cylinder pairs are of equal size resulting in equal stroke lengths and stroke speeds in either direction. To achieve different stroke end positions, for instance, when forging rectangular stock, feed lines are provided to the pressure lines 21, 22, 23 and 24 via three-way valves 14, 11, 12 and 13, which enable the liquid volume in the cylinders and, thus, the piston end positions to be changed. Using a control line 30, the three-way valves 11, 12, 13 and 14 are connected to a circuit that is fed by a pump 9 with a priming valve 10.

Controlled by a forging program, the three-way valves 14, 11, 12 or 13 are open at idle or pressureless conditions of the main lines, allowing pressure medium to flow in or out. During the reverse movement of the cylinder-piston units 1 and 2, the three-way valve 14 may be connected to the tank while the piston of unit 1 is pulled back in the direction of the arrow to move the piston stroke of unit 1 further outward. In the opposite sense, the three-way valves can be connected to pump 9 to move the stroke inward.

An electronic computer system ensures control of pump assemblies 5 and 6, and three-way valves 11, 12, 13 and 14, as well as evaluation of the signals supplied by the measuring devices.

In another embodiment according to the invention, the cylinder-piston units 2 and 4 are combined in one unit that is supplied simultaneously by pump assemblies 5 and 6. The result is a double press with two cylinder-piston units that is ideally suited to forge slabs on an anvil. With this arrangement, one cylinder-piston unit applies pressure from above with double the strength, while the two other cylinder-piston units apply pressure from the sides.

What is claimed is:

1. Double press for forging round or edged bar-shaped workpieces using two presses offset at a 90° angle from one another, each having a pair of forging dies (A1, A2, B1, B2) hydraulically working against each other and alternatingly driven by pump assemblies (5, 6), wherein the pairs (I, II) of the forging dies are driven alternatively, where each of the pump assemblies (5,6) at their respective discharge side are connected to one of the cylinder-piston units (1, 3; 2, 4) and their forging dies are connected to one of the cylinder-piston units (1, 3) of a forging die (A1,A2) of one pair (I0 and at their respective suction side are connected to one of the cylinder-piston units (2,4) of a forging die (B1, B2) of the other pair (II), and wherein continuous uninterrupted hydraulic main lines (21, 22, 23, 24) interconnect the pump assemblies and the cylinder-piston units (1,2, 3,4);

a delivery direction of the pump assemblies (5, 6) is reversible; and the two presses are arranged in the direction of the longitudinal axis of the workpiece in two consecutive planes offset from one another.

2. Double press according to claim 1, wherein an amount of pressure medium delivered by the pump assemblies is adjustable.

3. Double press according to claim 1, wherein the pump assemblies (5, 6) each consist of a plurality of pumps connected in parallel.

4. Double press according to claim 1, further comprising gas-pressurized liquid storage areas (7, 8) connected to said cylinder-piston units.

5. Double press according to claim 1, further comprising sensors (31, 32, 33, 34) which are attached to the forging dies (A1, A2, B1, B2) to measure the stroke of the pistons.

6. Double press according to claim 1, wherein the main lines are connected to safety valves (25, 26, 27, 28).

7. Double press according to claim 1, wherein the main lines are connected to check valves (17, 18, 19, 20) to prevent backflow.

8. Double press according to claim 7, wherein the check valves (17, 18, 19, 20) are connected to a pump (15) primed by a priming valve via a fill line (29).

9. Double press according to claim 1, wherein the main lines (21, 22, 23, 24) are connected to controllable three-way valves (11, 12, 13, 14).

10. Double press according to claim 9, wherein the three-way valves (11, 12, 13, 14) are connected to a pump (9) primed by a priming valve (10) via a control line (30).

11. A double press for forging a bar-shaped workpiece (35) having a longitudinal axis, comprising a first press (I) having first (A1) and second (A2) mutually opposing forging die/cylinder-piston units, each connected via a respective uninterrupted hydraulic line (21, 22) to a respective side of a first pump assembly (5) which drives said units alternately;

a second press (II) having third (B1) and fourth (B2) mutually opposing forging die/cylinder-piston units, each connected via a respective uninterrupted hydraulic line (23, 24) to a respective side of a second pump assembly (6) which drives said units alternately; wherein said first and second presses have respective axes of motion which are angularly offset from each other about said longitudinal axis of said workpiece (35);

and said first press is located in a first plane intersecting said longitudinal axis and said second press is located in a second plane intersecting said longitudinal axis, said first and second planes being offset, along said longitudinal axis, from each other.

12. A double press according to claim 11, wherein said presses have axes of motion angularly offset by 90° from each other.

13. A double press according to claim 11, wherein said pump assemblies convey pressure medium along said hydraulic lines in a reversible delivery direction, one side of each pump assembly acting as a pressure medium discharge side while the other side of the pump assembly acts as a pressure medium suction side.

14. A double press according to claim 11, further comprising branch hydraulic lines connected to said uninterrupted hydraulic lines between said pump assemblies and forging die/cylinder-piston units, said branch hydraulic lines each including a respective check valve (17, 18, 19, 20) to prevent backflow.

15. A double press according to claim 11, further comprising branch hydraulic lines connected to said uninterrupted hydraulic lines between said pump assemblies and forging die/cylinder-piston units, said branch hydraulic lines each including a respective safety valve (25, 26, 27, 28).

* * * * *

UNITED STATES PATENT AND TRADEMARK OFFICE

CERTIFICATE OF CORRECTION

PATENT NO. : 5,732,588

DATED : Mar. 31, 1998

INVENTOR(S) : Pahnke

It is certified that error appears in the above-identified patent and that said Letters Patent is hereby corrected as shown below:

Column 2, line 12 "cylinder piston units" should read --cylinder-piston units--

Column 3, line 61 "is dram" should read --is drawn--

Column 4, line 2 "branches of" should read --branches off--

Signed and Sealed this

Fourteenth Day of July, 1998

Bruce Lehman

*Attest:*

BRUCE LEHMAN

*Attesting Officer*

*Commissioner of Patents and Trademarks*